US008113179B1

(12) United States Patent
Bright

(10) Patent No.: US 8,113,179 B1
(45) Date of Patent: Feb. 14, 2012

(54) PROGRAMMABLE DIESEL FUEL INJECTOR

(75) Inventor: Charles B. Bright, Ames, IA (US)

(73) Assignee: Great Plains Diesel Technologies, L.C., Ames, IA (US)

( * ) Notice: Subject to any disclaimer, the term of this patent is extended or adjusted under 35 U.S.C. 154(b) by 65 days.

(21) Appl. No.: 12/853,652

(22) Filed: Aug. 10, 2010

(51) Int. Cl.
*F02M 51/00* (2006.01)
*F02M 51/06* (2006.01)

(52) U.S. Cl. ..... 123/490; 123/498

(58) Field of Classification Search ..... 123/490, 123/494, 498, 499; 239/102.2, 102.1, 585.1, 239/533.2, 900, 129.15, 129.21
See application file for complete search history.

(56) References Cited

U.S. PATENT DOCUMENTS

| | | | | |
|---|---|---|---|---|
| 4,022,166 | A | 5/1977 | Bart | |
| 4,175,587 | A | 11/1979 | Chadwick et al. | |
| 5,031,841 | A | 7/1991 | Schafer | |
| 5,779,149 | A | 7/1998 | Hayes, Jr. | |
| 5,810,255 | A | 9/1998 | Itoh et al. | |
| 6,079,636 | A | 6/2000 | Rembold et al. | |
| 6,253,736 | B1 | 7/2001 | Crofts et al. | |
| 6,570,474 | B2 | 5/2003 | Czimmek | |
| 6,577,776 | B1 | 6/2003 | Hatalsky | |
| 6,758,409 | B1 | 7/2004 | Itoh | |
| 7,140,353 | B1 | 11/2006 | Rauznitz et al. | |
| 7,196,437 | B2 | 3/2007 | Mori | |
| 7,255,290 | B2 | 8/2007 | Bright et al. | |
| 7,500,648 | B2 | 3/2009 | Kammerer et al. | |
| 2005/0274820 | A1 * | 12/2005 | Bright et al. | 239/102.2 |
| 2007/0007363 | A1 * | 1/2007 | Mifuji et al. | 239/102.2 |

* cited by examiner

*Primary Examiner* — Mahmoud Gimie
(74) *Attorney, Agent, or Firm* — Zarley Law Firm, P.L.C.

(57) ABSTRACT

An apparatus for injecting fuel into a combustion chamber of an internal combustion engine. The apparatus includes a solid magnetostrictive material with a favored direction of magnetostrictive response formed into a shape with ends that are substantially parallel to each other and substantially perpendicular to the favored direction of magnetostrictive response. A fuel control valve element is located coaxial to the favored direction of magnetoelastic response of the magnetostrictive material, the element opening inwardly. A solenoid coil is located concentric with the magnetostrictive material and coaxial to the favored direction of magnetoelastic response, the solenoid coil adapted to excite the magnetostrictive material into mechanical motion. An excitation signal is provided within the solenoid coil consisting of a main current signal with a superposed alternating signal approximately the width of a hysteresis loop of the solid magnetostrictive material. Finally, a magnetic return path circuit in magnetic communication with the solid magnetostrictive material is provided.

17 Claims, 6 Drawing Sheets

PROGRAMMABLE DIESEL FUEL INJECTOR

TECHNICAL FIELD OF THE INVENTION

The present invention relates generally to high pressure fuel injectors for internal combustion engines. More specifically, this invention is directed to a programmable diesel fuel injector with an internal electro-mechanical transducer with electrically selectable continuously variable control over stroke and speed that enables fuel injection rates of virtually any necessary shape, including multiple short pulses and/or gradual admission of the combustible fuel from the same injector, wherein the complexity required to form the rate shape is shifted from the mechanical portion of this simplified injector to electrical or electronic means.

In Sadi Carnot's translated words: "The necessary condition of the maximum is, then, that in the bodies employed to realize the motive power of heat there should not occur any change of temperature which may not be due to a change of volume. Reciprocally, every time that this condition is fulfilled the maximum will be attained. This principle should never be lost sight of in the construction of heat engines; it is its fundamental basis. If it cannot be strictly observed, it should at least be departed from as little as possible."

Rudolf Diesel described the most efficient engine for converting heat into mechanical work. The optimum fuel economy for the engine bearing his name occurs when the combustible is admitted such that the bulk temperature of the combustion gases does not rise due to combustion, that peak temperature having been achieved solely by air compression. The rate at which to inject fuel of a specific heating value is that rate at which the heat released by the self-ignited combustion of that fuel maintains a constant bulk temperature. Following the semi-perfect gas law, the bulk gas experiences a pressure decrease as the piston withdraws. However, admitting the combustible to maintain temperature results in net work since pressure remains higher than during the compression stroke. Gradually admitting the combustible as prescribed results in maximum fuel economy and therefore minimum emission of carbon dioxide. Maximum fuel economy occurs since heat transfer from the bulk gas is minimized by not letting its temperature rise by combustion.

Formation of pollutants is controlled by combustion complexities. One of the most important ways to control combustion and thereby control both fuel economy and pollutant formation is the method of admitting the combustible; the method of injecting fuel into the hot, compressed, swirling, oxygen-rich air inside the combustion chamber. Diesel himself noted in his U.S. Pat. No. 608,845 that soot was generated from the coal dust he admitted.

The progress of diesel engine pollutant control includes a steady rise in the pressure of the liquid fuel supplied to the injectors. The state of the art is in the range of 35,000 psi. For perspective, pressures in this range are more than half of the highest pressure inside the case of a firearm cartridge upon discharge.

Much technical literature and prior art patents reveal that metering very quick jets or pulses of standard number two liquid petroleum diesel fuel helps to reduce pollutants. High pressure improves fuel atomization and, for very quick jets, mixes enough finely atomized fuel with fresh, oxygenated air.

In sum, high pressure is the state of the art, fast injector speed is required, and more precise fuel metering with respect to time, a process termed rate shaping, is needed. Having the ability to "gradually admit the combustible" offers the potential of greatly increasing fuel economy while very quick jets of finely atomized fuel offers the potential of preventing the formation of pollutants, thus minimizing or potentially eliminating exhaust system equipment to neutralize the pollutants.

A fuel pressure in the range of 35,000 psi is a potent source of high-grade mechanical energy that can assist with the high speed required of the injector by being directed to accelerate and position solid internal mechanical elements. But, to direct the fuel when and where required to admit the combustible both gradually and/or in quick jets as the engine load and speed vary but in keeping with best emissions, the means of direction within the injector preferably has continuously variable control over both stroke and speed. Restated, such an injector should rate shape the injected fuel such that the bulk temperature of the combustion gases does not increase as the fuel is injected over all speed and load conditions of the engine, while simultaneously being able to inject very short individual pulses to keep formation of pollutants low, which is the object of this invention. Rate shaping refers to the volumetric flow rate that is varied or shaped with respect to time, and the term "very high speed rate shaping" applies with regard to the object of this invention.

Although, as described hereafter, appearing in the prior art are elements necessary for a very high speed rate shaping injector that take advantage of high pressure, none of the prior art discloses an injector which provides 1) use of high pressure with 2) continuously variable control over both stroke and speed 3) the durability to survive the heat and vibration present on a diesel engine cylinder head and 4) a simplified arrangement.

For all of the different prior art fuel injectors cited below in which use is made of the continuously variable control over both stroke and speed promised by a piezoelectric ceramic actuator, U.S. Pat. No. 7,255,290 details how piezoelectric ceramics degrade with use, meaning that any injector employing such an actuator is forced to limit stroke and speed to obtain acceptable life. Piezoelectric ceramics have been known for decades yet the continuation of the art to rate shape using means that are primarily mechanical indicates the degree of difficulty that has been encountered in the employment of piezoelectric ceramics within fuel injectors.

Limiting stroke and speed to obtain some durability from piezoelectric ceramic actuators rather than the terbium alloy actuators raises minimum emissions. Because of the different mechanism of magnetostriction in the terbium alloy, the terbium alloy is not subject to this degradation, thereby allowing extraction of the full range of stroke and speed while surviving on an engine.

U.S. Pat. No. 4,022,166 claims a steel needle displacement of 0.006 to 0.010 inches in 30-150 microseconds, but suffers from excess accelerated mass, including its biasing spring 58, which will reduce its speed, and the use of a piezoelectric stack.

U.S. Pat. No. 4,175,587 points out that the rate of voltage rise across a piezoelectric ceramic stack should be controlled within certain limits to avoid arcing between the positive and negative electrodes interleaved between discs in the stack. Depending on the particular configuration, this limit may restrict the speed of any injector using piezoelectric ceramic.

U.S. Pat. No. 5,031,841 discloses the sensitivity of exposing piezoelectric ceramic stacks to water, a common contaminant in fuel. Water is an electrical conductor. The terbium alloy is different in that because it contains iron it will "rust" if continually exposed to water for a long period of time.

U.S. Pat. No. 5,779,149 uses the fuel as part of the compensation for thermal expansion differences, solves the problem of reversing the direction of actuation, where an expanding transducer causes the needle to travel in the opposite direction, and uses a piston with an area ratio. But it also uses springs for preloading a piezoelectric stack and a first chamber filled with low pressure fuel. The springs slow its speed and do not allow the stack to take advantage of the pressure available for preloading.

U.S. Pat. No. 5,810,255 uses two piezoelectric stacks, the second being in a novel way to compensate for thermal expansion by clamping.

U.S. Pat. No. 6,079,636 uses either a piezoelectric or magnetostrictive actuator as a pump to pressurize the fuel. Both piezoelectric and magnetostrictive materials mimic the force and stroke of thermal expansion except much faster. The low bulk modulus of liquid fuels requires much displacement to raise pressure significantly, meaning it will be difficult for such an actuator to provide meaningful pressure and flow. This inability for a piezoelectric actuator to pressurize fuel is also noted in U.S. Pat. No. 5,979,803. Besides being complex to fabricate and not taking advantage of the high pressure available for better atomization, U.S. Pat. No. 6,079,636 will require big and bulky and therefore slow transducers.

U.S. Pat. No. 6,253,736 uses relatively large masses which slow acceleration, a bias spring the mass of which also slows acceleration, and a piezoelectric stack. Impact of a valve element causes a voltage spike to appear, which will cause the performance of the piezoelectric stack to degrade even faster than pointed out in U.S. Pat. No. 7,255,290, if it does not crack first.

U.S. Pat. No. 6,557,776 discloses an initial very short pulse followed by an unrestricted injection flow rate, which will raise the bulk gas temperature.

U.S. Pat. No. 6,570,474 shows the basic, simple component arrangement but uses preload springs and limits the terbium alloy compressive preload to 5-15 MPa. This ensures that the terbium alloy is bulky and has a lower Young's modulus and higher magnetic permeability. The added mass of the preload springs slows it further. U.S. Pat. No. 7,255,290 explains that high compressive pre-stress on the terbium alloy reduces the bulk that requires acceleration, increases stiffness, and reduces electrical inductance, all of which act together to raise speed.

U.S. Pat. No. 6,758,409 uses pressurized fuel to compensate for thermal expansion differences but employs springs to preload a piezoelectric stack. Springs add mass to accelerate, slowing down the injector. U.S. Pat. No. 6,758,409 applies voltage to the stack continuously until it is removed for injection to occur by a claimed stroke of up to 0.25 mm. Designing the injector to be closed with voltage applied means that removing voltage has the unfortunate consequence of allowing continuous injection in the event of a fault that disables that voltage.

U.S. Pat. No. 7,140,353 uses a piezoelectric ceramic actuator.

U.S. Pat. No. 7,196,437 inserts bias magnets in line with the magnetostrictive transducing material. Adding inert material forces the entire transducing member element to lengthen, adding mass to accelerate. Since the bias magnets are made from a different material, column buckling strength is reduced, for which diameter must be increased to compensate. The presence of bias magnets reduces magnetic permeability and therefore reduces electromechanical coupling, forcing input energy requirements to increase in compensation. Bias magnets will add bulk and make handling difficult.

U.S. Pat. No. 7,500,648 uses a spring for preload and seals the fuel, disabling convective cooling, has excess accelerated mass, and does not reverse the expansion of the actuator which precludes the use of atomizing nozzles.

The objective of the fuel injector in accordance with U.S. Pat. No. 7,255,290 (the "290" patent) is to quickly vary the volumetric flow rate of diesel oil being injected, a process termed "rate shaping." This is achieved by high compression of the magnetostrictive terbium alloy and by reducing the number of turns in the helical energizing winding. The 290 patent is hereby incorporated in its entirety.

High compressive stress on the terbium alloy contributes to speed in three ways, two of which are intimately related through the magnetostrictive transduction mechanism employed in this injector. First, at high compressive stress, the same force requires less cross-sectional area and therefore less mass. In other words, the same force has less mass to accelerate, allowing higher acceleration and therefore quicker positioning of internal valve elements. Second, the high compressive stress increases the variable Young's modulus of the terbium alloy. Third, the high compressive stress reduces magnetic permeability of the terbium alloy, reducing electrical inductance which then permits current to increase at a faster rate for the same voltage, an electrical effect analogous to the higher mechanical acceleration. In other words, the high compressive preload stress on the terbium alloy raises the density of the mechanical energy stored within it. Obtaining high acceleration of smaller masses is enabled by magnetically manipulating the elastic modulus of the terbium alloy, which affects the balance of forces within the injector. This is the origin of the continuously variable stroke and speed.

Even so, the fuel injector in accordance with the 290 patent can be improved further. First, the amount of accelerated mass can be reduced. Second, the required length and diameter of the complete injector can be shrunk, allowing it to fit into smaller spaces. Third, fatigue, friction, and wear can be eliminated. Fourth, thermal expansion differences between the terbium alloy and the rest of the injector, critical due to the available displacement, can be automatically compensated for. Fifth, the provision of a simpler injector can reduce fabrication costs. Sixth, improvements could be made wherein the compressive preload stress induced by the preload mechanism does not change with displacement, undesired motions are not excited, assembly is simplified, and finally, precision machining tolerances in the axial direction of the injector become unnecessary.

The prior art's utilization of springs to apply a compressive preload present several disadvantages, and many of such improvements can be accomplished by the removal of mechanical springs that apply a compressive preload. Springs that can apply the required compressive preload at the required stiffness and survive the fatigue requirements have either relatively large diameter as in the case of disc springs or long length as in the case of coil springs. Conserving diameter is preferred for any device on an engine cylinder head but this is in direct conflict with the transducer advantage of locating the spring closer to the tip of the injector that protrudes into the combustion chamber. Even though a spring that increases diameter would have the advantage of being shorter with less mass to accelerate, it may be very difficult to fit it onto a particular engine. Friction and fretting wear on the edges of this type of spring would limit injector life.

The second kind of spring adds length and bulk which also add much more mass to be accelerated, limiting performance. Besides mass, moving elements that are relatively long and thin will show a tendency to bend and vibrate and therefore would need to be guided, adding fabrication cost. The spring itself will interact with the deflections and speed required, slowing the needle and introducing undesired motions to it.

Design and fabrication complexity is introduced by the need to compress the springs during assembly. This preload must be applied without subjecting the brittle terbium alloy rod to any twist or misaligned end pieces. The mechanism would need to apply the preload carefully and lock it in place for the life of the injector.

Therefore, it is an object of this invention to improve upon and overcome the foregoing drawbacks present within prior art devices.

It is an object of the present invention to provide an injector that enables almost arbitrary rate shaping of high pressure diesel oil.

It is an object of the present invention to provide the capability to inject fuel such that the bulk temperature of the combustion gases remains constant throughout the complete cycle of combustion.

It is an object of the present invention to provide the capability to inject fuel using a rate shape such that the need for treating exhaust gases to minimize pollutants is reduced or eliminated.

It is an object of the present invention to be able to adapt the rate shape to liquid fuels of different physical, chemical, and combustion characteristics such as viscosity, density, surface tension, and heating value without changing any part inside the injector itself.

It is an object of the present invention to be able to adapt the rate shape to differing physical conditions such as internal wear of the injector, small differences in fabrication between injectors and cylinders, and gradual changes in fuel supply pressure.

It is an object of the present invention to use an electromechanical transducing material that expands outwardly to open the needle inwardly.

It is an object of the present invention to maximize the energy density stored within the electromechanical transducing material.

It is an object of the present invention to use fuel pressure instead of a spring as the means to raise the density of the mechanical energy stored within the electromechanical transducing material.

It is an object of the present invention to minimize accelerated mass inside the injector.

It is an object of the present invention to avoid any need to isolate internal parts from contact with fuel.

It is an object of the present invention to provide a diesel fuel injector that can be retrofitted to existing engines.

It is an object of the present invention to bring the utility of terbium alloy magnetostrictive materials into more common use, particularly for use in liquid fuel injectors for internal combustion engines.

It is an object of the present invention to operate at low voltage such that corona discharge and short circuiting does not occur.

It is an object of the present invention to eliminate fatigue cracking of the transducing material.

It is an object of the present invention to eliminate performance degradation of the transducing material.

It is an object of the present invention to eliminate the use of precious metals and/or strategic materials in the injector and any exhaust aftertreatment devices.

It is an object of the present invention to eliminate the use of bias magnets in the injector.

It is an object of the present invention to provide a lightweight, durable, compact, programmable diesel fuel injector.

It is an object of the present invention to avoid mechanical complexity to obtain programmability.

It is an object of the present invention to embed the fuel injector as far as possible into the cylinder head to reduce the total mass requiring acceleration.

It is an object of the present invention to provide automatic compensation of thermal expansion differences.

It is an object of the present invention to improve positioning accuracy by reducing the effects of hysteresis.

These and other objects, features or advantages of the present invention will become apparent from the specification and claims.

BRIEF SUMMARY OF THE INVENTION

An apparatus for injecting fuel into a combustion chamber of an internal combustion engine includes a solid magnetostrictive material with a favored direction of magnetostrictive response formed into a shape with ends that are substantially parallel to each other and substantially perpendicular to the favored direction of magnetostrictive response. A fuel control valve element is located coaxial to the favored direction of magnetoelastic response of the magnetostrictive material, the element opening inwardly. A solenoid coil is located concentric with the magnetostrictive material and coaxial to the favored direction of magnetoelastic response, the solenoid coil adapted to excite the magnetostrictive material into mechanical motion. The apparatus also includes an excitation signal within the solenoid coil consisting of a main current signal with a superposed alternating signal approximately the width of a hysteresis loop of the solid magnetostrictive material. Finally, a magnetic return path circuit in magnetic communication with the solid magnetostrictive material is provided.

DETAILED DESCRIPTION OF THE PREFERRED EMBODIMENT

Figure 1:
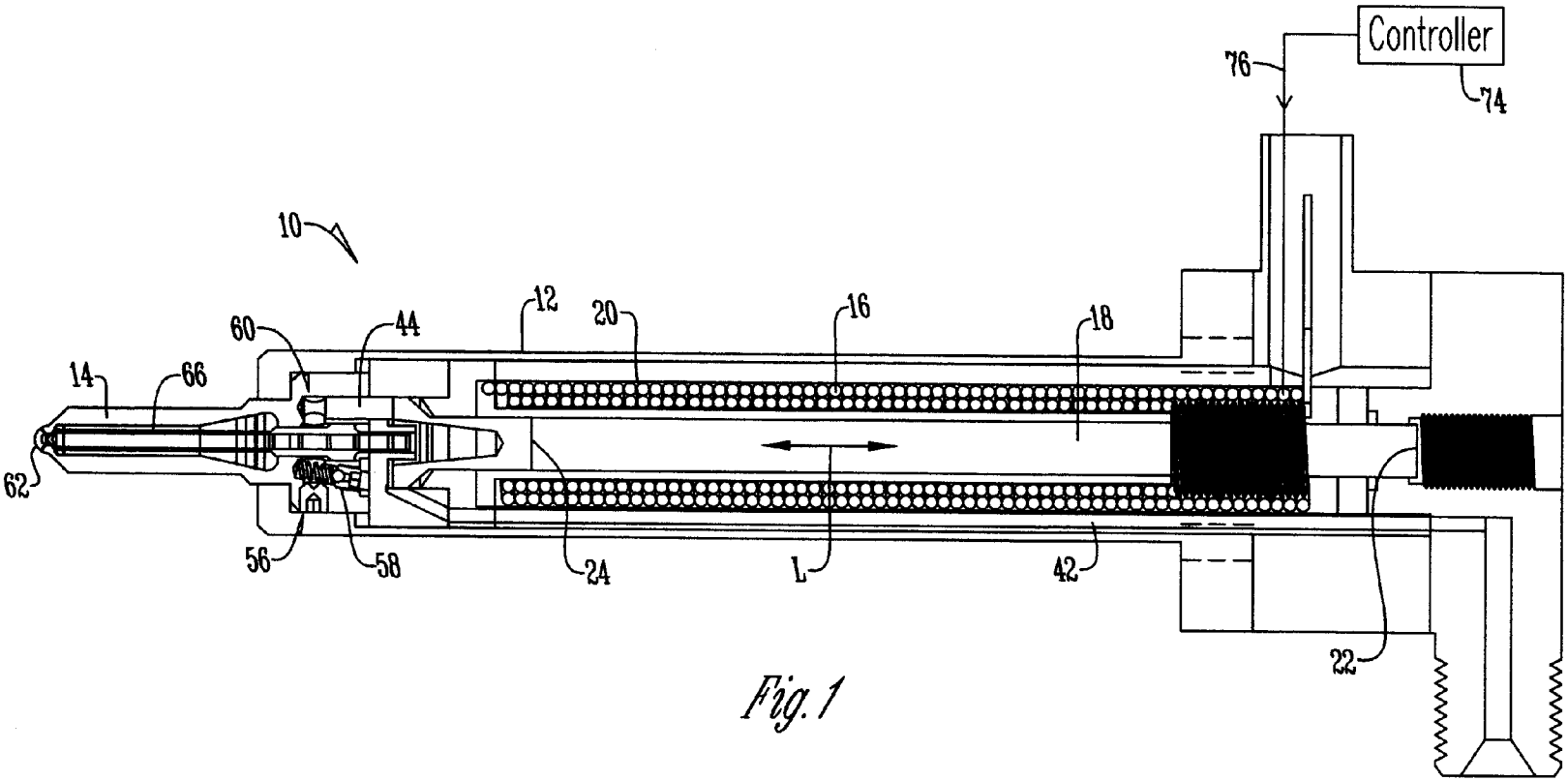
FIG. 1 is a side cross sectional view of the complete injector of the present invention.

Referring to the figures, an apparatus for injecting fuel 10 (also referred to herein as a fuel injector) comprises a housing 12 including a nozzle 14 supported therein and protruding from one end of the housing 12. Also provided in the housing 12 is an electromechanical transducer including a helically wound solenoid coil 16 concentrically surrounding a magnetostrictive material 18 and a magnetic return path circuit 20 is concentric to the helically wound solenoid coil 16 in magnetic communication with the solid magnetostrictive material 18. The magnetostrictive material 18 is provided as a solid magnetostrictive material 18, which in a preferred embodiment, is comprised of terbium alloy, having a first end 22 and a second end 24 that are substantially parallel to each other and substantially perpendicular to a favored direction of magnetostrictive response, L. Furthermore, the solenoid coil 16, located concentric with the magnetostrictive material 18 and coaxial to the favored direction of magnetoelastic response L is adapted to excite the magnetostrictive material 18 into mechanical motion. An end member 26 has a first end 28 which forms an adjacent, abutting connection to the second end 24 of the magnetostrictive material 18 and extends to a second end 30. The second end 30 includes a central recess 32 forming an axial center opening in the second end 30 of the end member 26 and additionally includes an outer flange 34 surrounding the periphery of the central recess 32. The end member 26 is housed between a first end member block 36 and a second end member block 38 and is permitted to move axially in response to the axial expansion of the magnetostrictive material 18 in a chamber 40 formed therebetween which is in fluid communication with fuel vent line 42.

Also provided is a piston 44 driven by the electromechanical transducer. Piston 44 has a first side on a first end 46 of piston 44 which directly adjacent to and abutting the outer flange 34 of the end member's 26 second end 30 such that piston 44 is in operative disposition and engagement with magnetostrictive material 18. Piston 44 further has a second side on a second end 48 of piston 44 adjacent a hydraulic chamber 50 containing a closed fuel volume 52 such that the second side on the second end 48 of piston 44 forms a wall 54 of the hydraulic chamber 50 in fluid communication with the pressure source to form a closed, pressurized volume via the flow restrictor 56, all of which forming a fuel pressure mechanism 60, as hydraulic chamber 50 is also in fluid communication with a flow restrictor 56. In one embodiment, flow restrictor includes check valve 58. Alternatively, flow restrictor 56 includes a serpentine passage comprised of serpentine lines for high flow resistance but also provided with passageways that will not become plugged by any contaminant particles. Furthermore, fuel pressure mechanism 60 is associated with the magnetostrictive material 18 and is adapted to using fuel pressure to subject the magnetostrictive material 18 to a static compressive stress magnitude of no less than fifteen megapascals along the favored direction of magnetostrictive response L with an effective stiffness no greater than one-fourth the stiffness of the magnetostrictive element 18 without the magnetostrictive material 18 being subjected to a magnetic field by the mechanism 60.

Nozzle 14 extends from an end of the housing to a tip 62 having nozzle ports 64. Nozzle 14 also includes a needle 66, which in a preferred embodiment is hollow. Needle 66 is disposed and moves axially within the interior of the nozzle 14. Nozzle 14 also includes an injection valve pressure chamber 68 adjacent the exterior surface of the needle 66 in fluid communication with fuel pressure line 70 such that axial movement and opening of the needle 66 allows pressurized fluid to flow through the ports 64 into the combustion chamber. Specifically, needle 66 extends within and is movably and axially displaced within the interior of the nozzle 14 from the tip 62 of the nozzle 14 to open and close the nozzle ports 64 in a closed position, into the housing 12 to interact and fluidly communicate with the fuel pressure mechanism 60 to form a fuel control valve element 72 which is located coaxial to the favored direction of magnetoelastic response L of the magnetostrictive material 18 opening inwardly such that as the transducer drives the piston 44, displaced closed volume fuel 52 modulates the needle 66 position. In an alternate embodiment, a control valve stem is attached directly to the piston 44, and in such an embodiment, it is preferred to provide additional means of thermal compensation.

Furthermore, a controller 74 is provided in electronic communication with the solenoid coil 16 and magnetostrictive material 18, wherein the controller 74 sends signals 76, including but not limited to current signals, to the solenoid coil 16 and magnetostrictive material 18 to actuate the solenoid coil 16 and magnetostrictive material 18 and produce electrical waveforms, rotate magnetic domains into alignment, and lessen the inhibition on magnetic domain rotation as described herein.

The present invention provides a high pressure fuel injector 10 for internal combustion engines and specifically to a programmable injector 10 for injecting high pressure diesel oil directly into a diesel engine combustion chamber. The continuously variable control over both stroke and speed of the electromechanical transducer enables almost arbitrary rate shaping that is electrically selectable, which helps minimize formation of diesel particulate matter and oxides of nitrogen pollutants while simultaneously minimizing bulk temperature increase during injection. Rate shaping refers to the volumetric flow rate that is varied or shaped with respect to time.

An arbitrary, non-zero, continuously variable electrical waveform is pre-determined to result in the desired fuel injection rate shape. The electrical waveform is supplied to a solenoid coil 16 which converts it into a corresponding magnetic field waveform. The solenoid coil 16 surrounds an element of terbium alloy magnetostrictive material 18. The terbium alloy magnetostrictive material 18 transduces the magnetic field waveform into a corresponding mechanical waveform. The mechanical waveform positions a hydraulic piston 44 which fluidically positions a valve element 72 to control flow rate.

The programmable features of the present invention include a thin solenoid coil 16 of relatively few turns, the ability of the electrical source to proportionally supply up to one hundred amperes at up to one hundred volts in no greater than ten microseconds, the terbium alloy magnetostrictive material 18 being subject to a bias compressive stress magnitude of no less than fifteen megapascals, accelerated mass being minimized, the magnetic flux path being minimized and designed to suppress eddy currents, and the preload being applied to the terbium alloy magnetostrictive material 18 by a piston 44 employing the supply pressure of the diesel oil.

Figure 2:
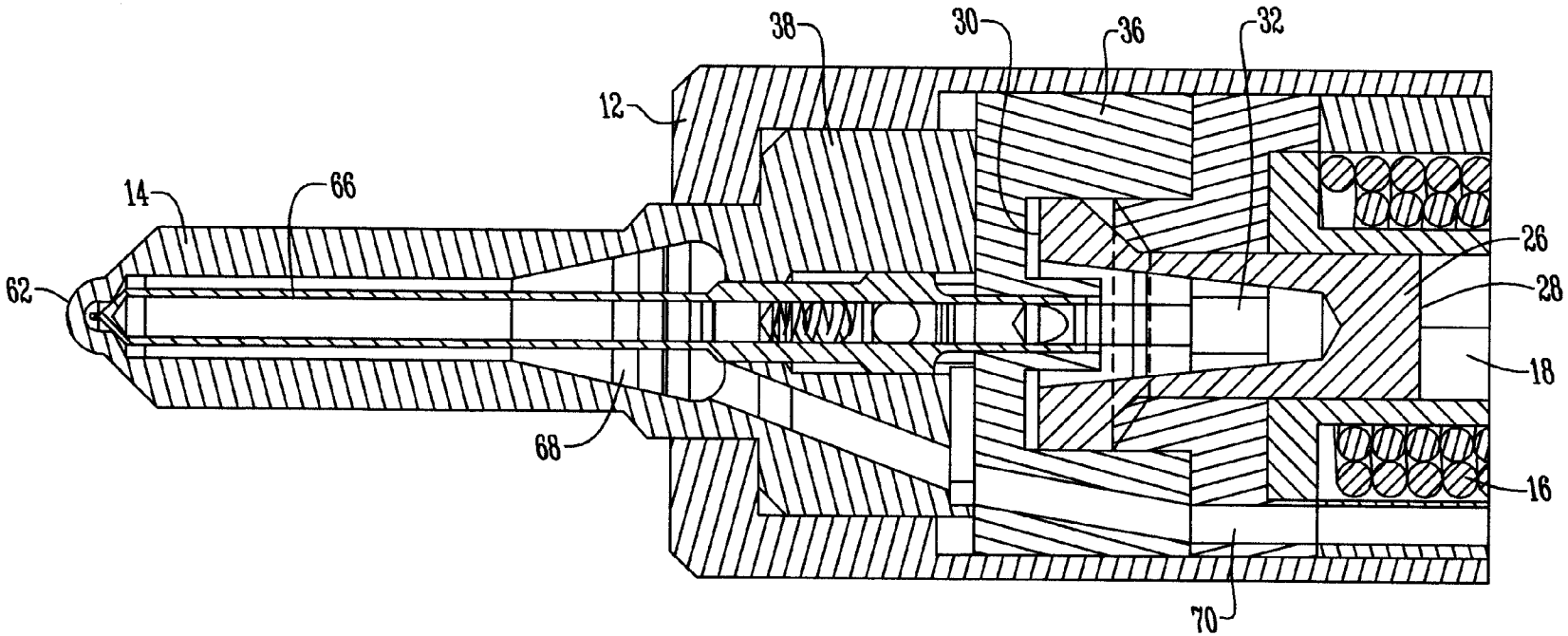
FIG. 2 is a top cross sectional view of the present invention.
Figure 3:
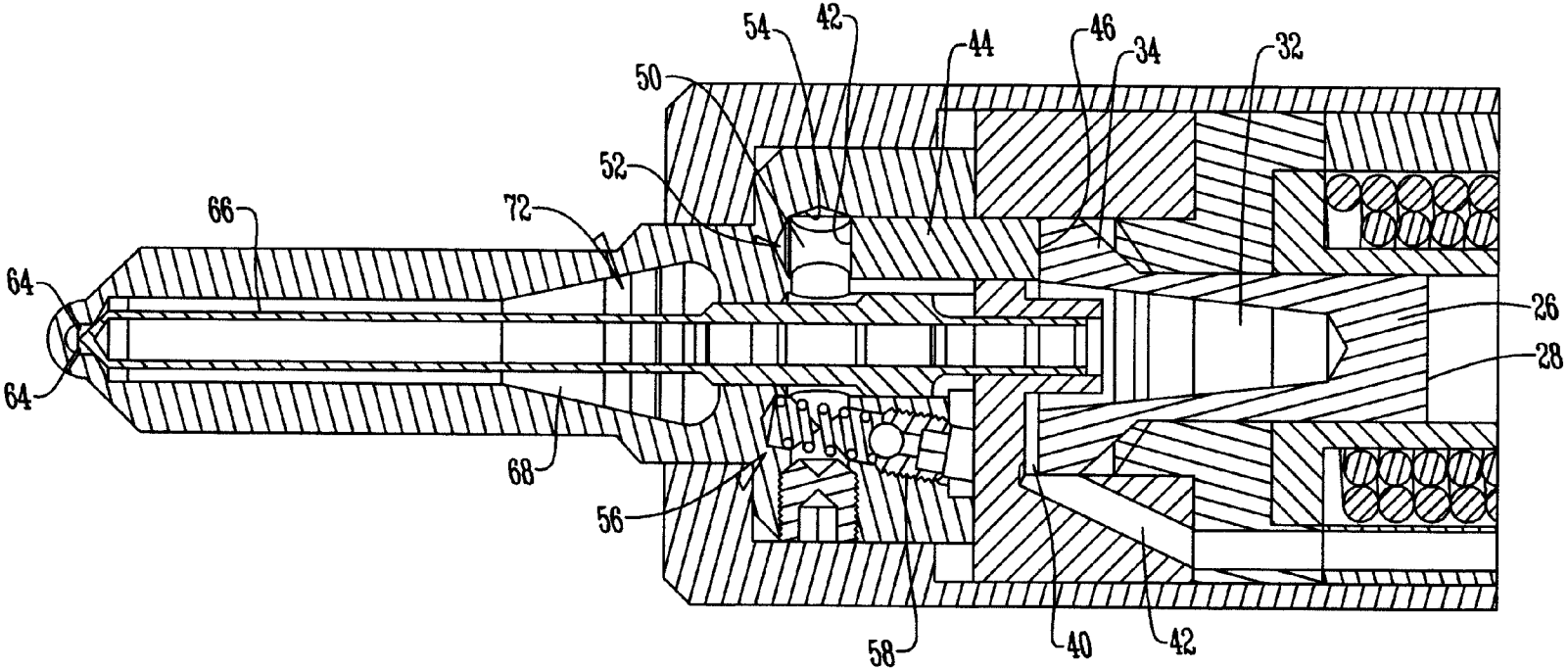
FIG. 3 is a side cross sectional view of the present invention.
Figure 4:
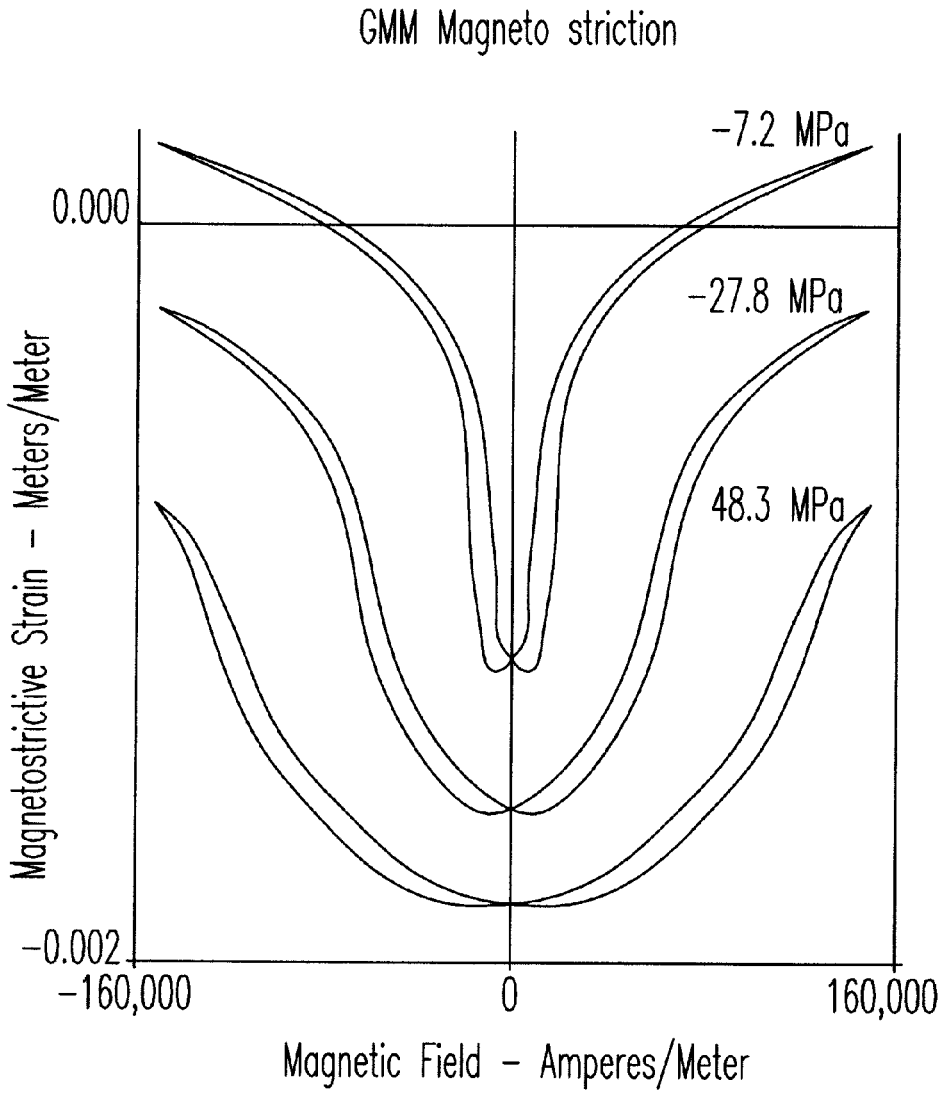
FIG. 4 graphs absolute magnetostrictive strain as a function of magnetic field strength for three different constant compressive stresses as originally shown in FIG. 1 of U.S. Pat. No. 7,255,290 to Bright, et al.
Figure 5:
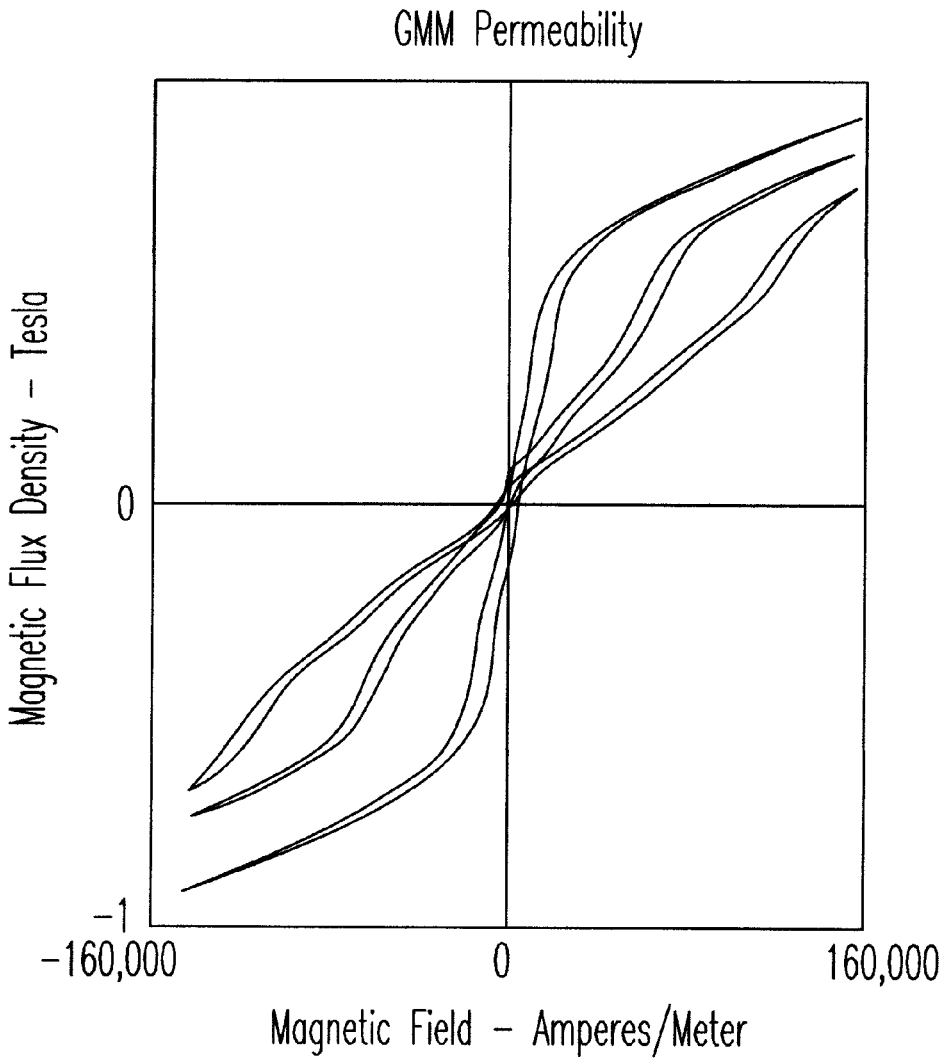
FIG. 5 graphs magnetic flux density as a function of magnetic field strength for three different constant compressive stresses as originally shown in FIG. 2 of U.S. Pat. No. 7,255,290 to Bright, et al.
Figure 6:
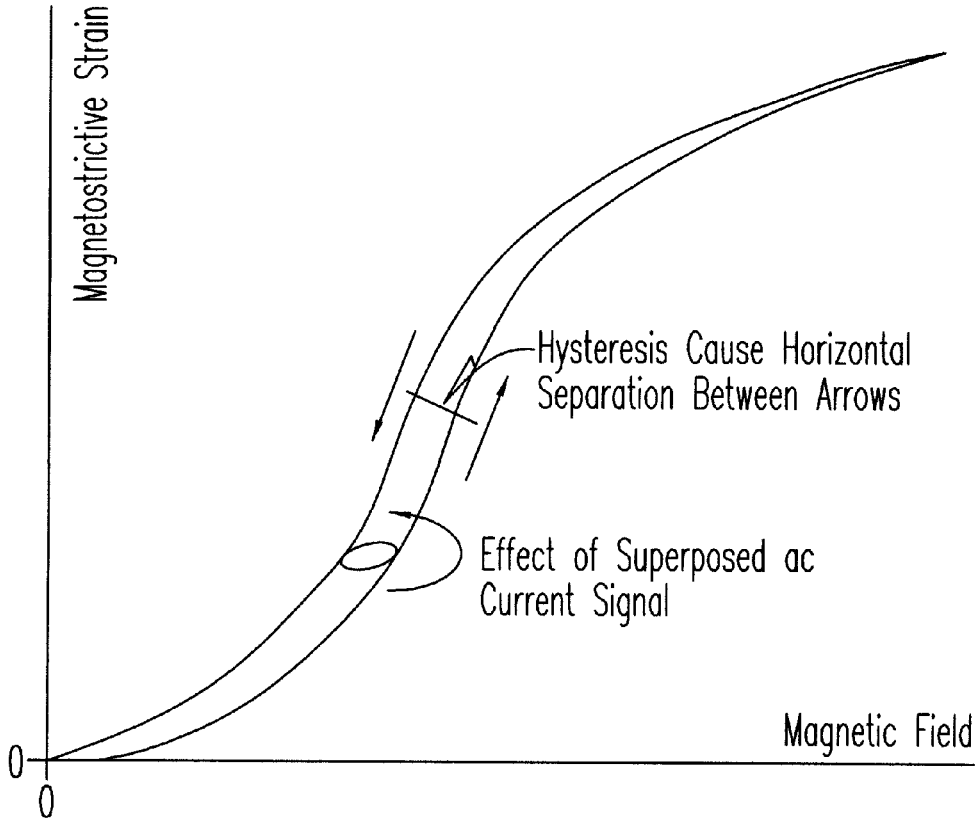
FIG. 6 graphs relative magnetostrictive strain as a function of magnetic field strength according to the present invention.

Furthermore, the injector 10 of the present invention is designed to improve its precision of positioning and the accuracy with which the valve element 72 opens to a desired position. By eliminating the need to compensate elsewhere, speed improves. FIGS. 4 and 5, originally shown as FIGS. 1 and 2 in the 290 patent but reproduced again here for convenience, show distinct hysteresis loops. The most noticeable problem is that the desired output of strain is different, depending on which direction it is approached from.

The origin of the hysteresis is the motion of the individual magnetic domains that make up the terbium alloy rod magnetostrictive material 18. An analogy is to consider what happens when attempting to smoothly pour a mixture of many ice cubes and water. When tilting the container, some water can be poured out while the ice cubes interact with each other to stay in position. At a critical pour angle, the ice cubes break free and an avalanche occurs. However, if the container is continuously shaken as the pour angle is increased, a much smoother and more predictable flow occurs.

In a comparable fashion as illustrated in the Figures, the present invention applies a small alternating signal 76 to the solenoid 16, to provide an excitation signal 76 within the solenoid coil 16 consisting of the main current signal 76 with a superposed alternating signal 76 approximately the width of the hysteresis loop of the solid magnetostrictive material 18, which decreases the inhibition on magnetic domain rotation, an enhancement that achieves more precise positioning of the valve needle 66, from either the open or closed directions, and less requirement for the electronic controller 74 to introduce an artificial compensation, thus simplifying the controller 74 while at the same time increasing the speed of the controller 74.

Furthermore, as shown by the Figures, the instant invention provides a mechanism 60 designed to utilize available fuel pressure wherein one side of a piston 44 is exposed to fuel pressure such that the other side of the piston 44 presses against the terbium alloy magnetostrictive material 18. The ratio of areas between one side 46 of the piston 44 and its other side 48 is designed to optimize the compressive stress on the terbium alloy magnetostrictive material 18 with respect to the available fuel pressure.

The piston 44 is sealed by a close-fitting tolerance between the piston and its bore. Although typically excess, un-controlled, and/or inadvertent leakage should be minimized as it represents a loss of energy that must be replaced by the fuel pump, and as a further consequence of leakage the temperature of depressurized fuel rises, which will preferably be accounted for in the design, in the present invention an appropriate degree of leakage is deliberate for several reasons. First, an elastomeric seal is unlikely to survive the combination of sealing against fuel pressure, the displacement of each cycle, and the number of cycles the injector will operate over its life. Second, a flexible metal seal that can meet the same combination will likely be difficult to fabricate reliably and therefore expensive. Third, the leakage can immerse the terbium alloy and the helically-wound energizing coil, providing temperature conditioning for best and/or maximum performance. This intentional leakage is returned to the engine fuel supply tank.

For a given pressure difference, the leakage flow rate is determined by the width and length of the channel formed between the piston 44 and its bore. Precise fabrication methods are preferred and available for choosing the leakage flow rate. Concentric self-alignment of the piston 44 in its bore is enabled by adding grooves around the piston, the grooves acting to balance the pressure at that point in the channel by evenly distributing it in the circumferential direction.

Long term fuel pressure supply variations are detected and compensated for by the magnitude of the electrical current preferred to operate the injector 10. Maximum injector rate shaping performance thus continues even though a maintenance or possible fault condition has been detected in the fuel system.

Fuel pressure variations are detected by "pinging" the terbium alloy magnetostrictive material 18 with a small electrical pulse 76 between injection events, that pulse being used to determine the magnetic permeability of the terbium alloy magnetostrictive material 18 and therefore the compressive stress that it is subject to.

The expansion of the terbium alloy magnetostrictive material 18 drives the piston 44 against a pressurized volume 52 that is effectively closed. "Effectively closed" means that the pressurized volume 52 is in fluid communication with the pressure source, but through a flow restriction 56 that acts to close that volume for the time in which needle 66 motion is required. That is, the pressure added to the effectively closed volume 52 by the terbium alloy magnetostrictive material 18 expansion cannot cause a significant amount of fluid to leak through the inlet flow restriction 56 and out of the closed volume 52 within the few milliseconds of time that the needle 66 is in motion to allow fuel to be injected.

The pressure from the effectively closed volume 52 is ported to one side of the needle 66 moving element that opens the nozzle ports and allows fuel to be injected. On the other side of the needle 66 is the unrestricted pressure supplied to the fuel injector 10. This combination of pressures acts across the needle 66 and is ordinarily balanced when the needle 66 is closed. Should one pressure change, the pressure balance across the needle 66 is altered, which accelerates the needle 66 one way or the other, thus repositioning it.

The ability to realize a highest possible speed from this injector 10 is enhanced by the highly compressed terbium alloy magnetostrictive material 18, which then has a small diameter and can be fitted further into the cylinder head. The masses of components to be accelerated and the fuel volumes undergoing compression, both of which sap time and energy between the transducer and the needle 66, are all minimized by locating the terbium alloy magnetostrictive material 18 as close to the tip 62 of the injector 10 as possible, wherein in one embodiment, the terbium alloy magnetostrictive material 18 is adjacent the injector nozzle needle 66 on the end opposite the needle tip 62. Leakage enables such a location by ensuring that the terbium alloy magnetostrictive material 18 and its helically-wound energizing coil 16 will not get too hot. Excess heat from the engine cylinder head will be removed by the leakage to be dissipated in the fuel tank, and as the fuel is injected such that it does not raise the bulk temperature of the gases in the combustion chamber, this cooling requirement is correspondingly reduced.

In operation the injector 10 of the present invention works as follows. In sequence, control of the current into the helical energizing winding 16 controls the expansion of the terbium alloy magnetostrictive material 18. The rate at which current increases and its maximum magnitude are transduced by the terbium alloy magnetostrictive material 18 into a corresponding mechanical expansion waveform. An alternating signal 76 superpositioned onto the main signal reduces hysteresis to improve positioning accuracy and speed of the valve element 72. The ability to control current provides the continuously variable stroke and speed claimed for this injector 10. Positioning of the piston 44 that forms part of the wall 54 of the effectively closed volume 52 controls the pressure in that volume 52. Control of the pressure in the effectively closed volume 52 affects the pressure balance across the injector needle 66, positioning it to control fuel injection into the combustion chamber.

Maximum speed is determined by matching the dynamic interactions between all components. Transfer of power between each component is maximized when the impedance of a load is matched to the impedance of its source. The injector 10 is thus designed to minimize the undesired loss of power through damping and friction while matching source and load impedances.

The desired fuel injection rate shape for any particular engine combines the original specification of adding fuel in a manner that does not raise the bulk temperature of the combustion gases with those characteristics necessary to minimize pollutant formation. For a given nozzle configuration, this rate shape will determine the dynamic pressure balance required across the needle 66. Anticipating that many individual pulses within a single injection event is the ideal rate shape, all parasitic drag that slows the needle are preferably identified and minimized. Parasitic drag includes the energy storage represented by accelerated masses and compressed stiffnesses as well as the energy dissipation represented by the many places friction will occur.

Once a required pressure balance is determined, achieving this balance can be realized by considering dynamics of the individual fuel volumes within the injector tip, the ratio of areas across the piston, the configuration of the terbium alloy magnetostrictive material 18, and the capability of the electrical power supply. As a result at the very least all of the stated objectives have been met.

It will be appreciated by those skilled in the art that other various modifications could be made to the device without the parting from the spirit and scope of this invention. All such modifications and changes fall within the scope of the claims and are intended to be covered thereby.

What is claimed is:

1. Apparatus for injecting fuel into a combustion chamber of an internal combustion engine comprising:

a solid magnetostrictive material with a favored direction of magnetostrictive response formed into a shape with ends that are substantially parallel to each other and substantially perpendicular to the favored direction of magnetostrictive response;

a fuel control valve element located coaxial to the favored direction of magnetoelastic response of the magnetostrictive material, the element opening inwardly;

a solenoid coil located concentric with the magnetostrictive material and coaxial to the favored direction of magnetoelastic response, the solenoid coil adapted to excite the magnetostrictive material into mechanical motion;

an excitation signal within the solenoid coil consisting of a main current signal with a superposed alternating signal approximately the width of a hysteresis loop of the solid magnetostrictive material; and a magnetic return path circuit in magnetic communication with the solid magnetostrictive material.

2. The apparatus of claim 1 further comprising a mechanism associated with the magnetostrictive material adapted to using fuel pressure to subject the magnetostrictive material to a static compressive stress, wherein the static compressive stress is comprised of a substantially constant pressure over a short period of time excluding pressure and flow dynamics from internal and external injection events.

3. The apparatus of claim 2 wherein the magnitude of static compressive stress is no less than fifteen megapascals along the favored direction of magnetostrictive response with an effective stiffness no greater than one-fourth the stiffness of the magnetostrictive element without the magnetostrictive material being subjected to a magnetic field by the mechanism.

4. The apparatus as claimed in claim 1 in which the solid magnetostrictive material comprises a grain-oriented polycrystalline rare earth-transition metal magnetostrictive material of the formula $Tb_xDy_{1-x}Fe_{2-w}$ wherein 0.20<=x<=1.00 and 0<=w<=0.20 wherein 0.20<=x<=1.00 and 0<=w<=0.20 wherein the grains of the material have their common principal axes substantially pointed along the growth axis of the material which is within 10° of the $\lambda_{111}$ axis.

5. The apparatus as claimed in claim 4 in which the solid magnetostrictive material is a rare earth-transition metal magnetostrictive material divided by a plurality of joints into an element of discrete magnetostrictive slabs.

6. The apparatus as claimed in claim 1 in which the solid magnetostrictive material is a rare earth-transition metal magnetostrictive material having a transverse dimension substantially smaller than one quarter wavelength at the electromechanical resonant frequency of the apparatus.

7. The apparatus as claimed in claim 6 in which the solid magnetostrictive material is a rare earth-transition metal magnetostrictive material having a length in the direction of magnetostrictive response of no greater than one quarter wavelength at the electromechanical resonant frequency of the apparatus.

8. The apparatus as claimed in claim 1 in which the control valve element is controlled by the magnetostrictive material in an analog fashion.

9. The apparatus as claimed in claim 1 in which the control valve element is controlled by the magnetostrictive material in a binary fashion.

10. The apparatus as claimed in claim 8 in which the control valve element analog movement controls the opening and closing rate of an injector nozzle needle.

11. The apparatus as claimed in claim 10 in which the nozzle needle opening rate controls a fuel injection rate shape.

12. The apparatus as claimed in claim 11 in which a nozzle needle opening and closing rate is controlled by operating an actuator in a "pulse width modulated" fashion.

13. The apparatus as claimed in claim 1 in which the magnetic return path circuit substantially surrounds the solenoid coil.

14. The apparatus as claimed in claim 13 in which the magnetic return path circuit material is ferrite.

15. The apparatus as claimed in claim 1 in which the control valve element includes a sealing component selected from the group consisting of a spherical ball with spring, a spherical ball without spring, a conical shape mated to a conical shape seat, a curvilinear shape mated to a conical shape seat, conical shape mated to a planar shape seat, and planar shape mated to a planar shape seat.

16. The apparatus as claimed in claim 1 in which the control valve movement is intensified by hydraulic pistons of dissimilar area that cooperate through displaced fuel in a chamber.

17. The apparatus of claim 1, wherein the shape of the solid magnetostrictive material is selected from the group consisting of a cylinder, ellipsoid, parallelepiped, and prismatic.

* * * * *